US011412803B2

(12) United States Patent
MacFarlane

(10) Patent No.: US 11,412,803 B2
(45) Date of Patent: Aug. 16, 2022

(54) GARMENT WITH SELECTIVE HOOD RETENTION AND METHOD OF SELECTIVELY RETAINING A HOOD

(71) Applicant: LEATT CORPORATION, Santa Clarita, CA (US)

(72) Inventor: Scott MacFarlane, Leicestershire (GB)

(73) Assignee: LEATT CORPORATION, Santa Clarita, CA (US)

( * ) Notice: Subject to any disclaimer, the term of this patent is extended or adjusted under 35 U.S.C. 154(b) by 173 days.

(21) Appl. No.: 16/964,259

(22) PCT Filed: Oct. 22, 2018

(86) PCT No.: PCT/IB2018/058197
§ 371 (c)(1),
(2) Date: Jul. 23, 2020

(87) PCT Pub. No.: WO2019/162740
PCT Pub. Date: Aug. 29, 2019

(65) Prior Publication Data

US 2021/0037904 A1 Feb. 11, 2021

(30) Foreign Application Priority Data

Feb. 20, 2018 (GB) ..... 1802733

(51) Int. Cl.
*A41F 1/00* (2006.01)
*A42B 1/048* (2021.01)
*A42B 3/08* (2006.01)

(52) U.S. Cl.
CPC ..... *A42B 1/048* (2013.01); *A41F 1/002* (2013.01); *A42B 3/08* (2013.01)

(58) Field of Classification Search
CPC ..... A42B 1/048; A41D 2200/20; A41D 23/00
See application file for complete search history.

(56) References Cited

U.S. PATENT DOCUMENTS

| | | | | |
|---|---|---|---|---|
| 7,380,286 | B1 * | 6/2008 | Bryant, Sr. | A42B 1/048 2/202 |
| 9,993,042 | B1 * | 6/2018 | Miller | A42B 1/041 |
| 2014/0338093 | A1 * | 11/2014 | Gersten | A42B 1/048 2/84 |
| 2015/0052661 | A1 * | 2/2015 | Poznick | A41D 23/00 2/202 |
| 2017/0245567 | A1 * | 8/2017 | Fathollahi | H02J 7/0044 |
| 2018/0007995 | A1 * | 1/2018 | Morales | A41D 1/04 |
| 2021/0204627 | A1 * | 7/2021 | Linchitz | A41D 3/005 |
| 2021/0244115 | A1 * | 8/2021 | Margulis | A41D 1/04 |

* cited by examiner

*Primary Examiner* — Tajash D Patel
(74) *Attorney, Agent, or Firm* — Stephen J. Weyer, Esq.; Stites & Harbison PLLC

(57) ABSTRACT

A hood (16) of an upper body garment (10) is selectively retained and deployed. A first retention element (18) is provided on a main garment portion (14), a second retention element (20) is provided on the hood (16) and optionally, a third retention element (28) is provided on a helmet (16). The garment (10) can be worn like a conventional garment, with the hood (16) up or down, but when the hood (16) is down, it is retained place behind the wearer's back, by magnetic attachment of the first and second retention elements (18,20). The hood (16) can also be worn over the helmet (26) and can be held in place by magnetic attachment of the third retention element (28) on the helmet (26), to the second retention element (20) on the hood (16).

8 Claims, 2 Drawing Sheets

GARMENT WITH SELECTIVE HOOD RETENTION AND METHOD OF SELECTIVELY RETAINING A HOOD

FIELD OF THE INVENTION

This invention relates to garments with hoods that can selectively be retained or stowed, or can be deployed for use. The garments are typically jackets, but can be any upper-body garment.

BACKGROUND TO THE INVENTION

Upper-body garments such as jackets are often provided with hoods that can cover the head of a wearer of the garment to provide protection against inclement weather, but the hood can also be selectively removed from the wearer's, while still wearing the garment. When the hoods of conventional garments are not in use, they typically extend loosely around the shoulders of the wearer and most of the hood extends loosely behind the wearer's neck or back.

When wearers of hooded garments participate in outdoor activities, their needs for wearing hoods vary depending on weather conditions, but also depending on the activities. In particular, when a wearer participates in a high speed activity such as motorcycling, or skiing, a hood that extends loosely behind the wearer's neck or back, is likely to be filled with air and cause significant drag behind the wearer, it can flap around in the wind, it can cause a visual or audible distraction, or obstruct the wearer's view, when looking over his shoulder. In all these instances, the hood would cause a nuisance to the wearer.

Other circumstances also exist, when a wearer might want to wear a jacket, but would not want to wear the jacket's hood and would prefer not to leave the unused hood extending loosely behind the wearer's neck or back. Examples include, when a wearer is participating intermittently an activity that requires headwear, such as a helmet, and the user sometimes wants to wear the hood under or over the helmet, but may want to take the hoof off, when stationary.

In some activities, hoods are worn underneath helmets, to assist in protection against inclement weather, whereas in other activities, hoods are frequently worn over helmets 13 also to protect the wearer selectively against inclement weather, or sometimes merely for personal preference, e.g. this is common practice for some cycling disciplines, snowboarding and skateboarding. However, when hoods are worn over helmets, they are prone to being dislodged by wind and/or by movements of the wearer.

Jackets have been proposed with hoods that are removable and some have hoods that can be stowed inside the jacket's collar, to be deployed when the hood is required. However, the removal and re-attachment of a hood, and the stowing of a hood in a collar and deploying the hood from the dollar, are all relatively cumbersome activities that require two hands and cannot be completed safely by a wearer of the jacket, while actively participating in demanding activities such as motorcycling.

The present invention seeks to provide upper-body garments with hoods that can be retained and deployed, with ease. The invention further seeks to provide for the retention of a hood that is selectively worn over a helmet.

SUMMARY OF THE INVENTION

According to a first aspect of the present invention there is provided an upper-body garment comprising:

a main garment portion that is configured for extending at least partly around the torso of a wearer;

a hood that is attachable to the main garment portion in a neck region of the garment, said hood being displaceable at least between: a deployed position in which the hood extends partly around the wearer's head, and a retained position in which the hood is disposed at least partly behind the wearer with the wearer's head being outside the hood;

said garment including at least a first retention element that is attached to the main garment portion and a second retention element that is attached to the hood, said first retention element and second retention element being magnetically attracted to each other, when they are in close proximity;

wherein said second retention element in attached to the hood at a position that is remote from the first retention element when the hood is in the deployed position, and that is in close proximity to the first retention element when the hood is in the retained position.

The second retention element may be attached to the hood at a position that is higher than the occipital region of the wearer's head, when the hood is in the deployed position.

The first retention element may be attached to the main garment portion at a position that is in the region of the nape of the wearer's neck and at least one of the first and second retention elements may be embedded in fabric of the upper-body garment.

The invention extends to a set comprising the upper body garment described herein above in combination with a helmet, said helmet including at least a third retention element and said second and third retention elements being magnetically attracted to each other when they are in close proximity to each other. The third retention element may be disposed in the helmet at a position that is higher than the occipital region of the wearer's head, when the helmet is worn by the wearer.

According to another aspect of the present invention there is provided a method of selectively retaining a hood, said method comprising:

providing a garment comprising main garment portion that is configured for extending at least partly around a torso of a wearer, a hood that is attachable to the main garment portion in a neck region of the garment, and at least a first retention element that is attached to the main garment portion and a second retention element that is attached to the hood, said first retention element and second retention element being magnetically attracted to each other, when they are in close proximity;

selectively retaining the hood in a retained position in which the hood is disposed at least partly behind the wearer with the wearer's head being outside the hood, by bringing the second retention element into such close proximity of the first retention element, to allow the first and second retention elements to be magnetically attracted to each other; and selectively deploying the hood to a deployed position in which the hood extends partly around the wearer's head, by moving the second retention element from the proximity of the first retention element, to avoid magnetic attraction between the first and second retention elements.

The wearer may wear a helmet on his head and the helmet may include a third retention element, and said method may include releasably attaching the second retention element magnetically to the third retention element, when the hood is in its deployed position.

BRIEF DESCRIPTION OF THE DRAWINGS

For a better understanding of the present invention, and to show how it may be put into effect, the invention will now be described by way of non-limiting example, with reference to the accompanying drawings in which.

DETAILED DESCRIPTION OF THE DRAWINGS

Figure 1:
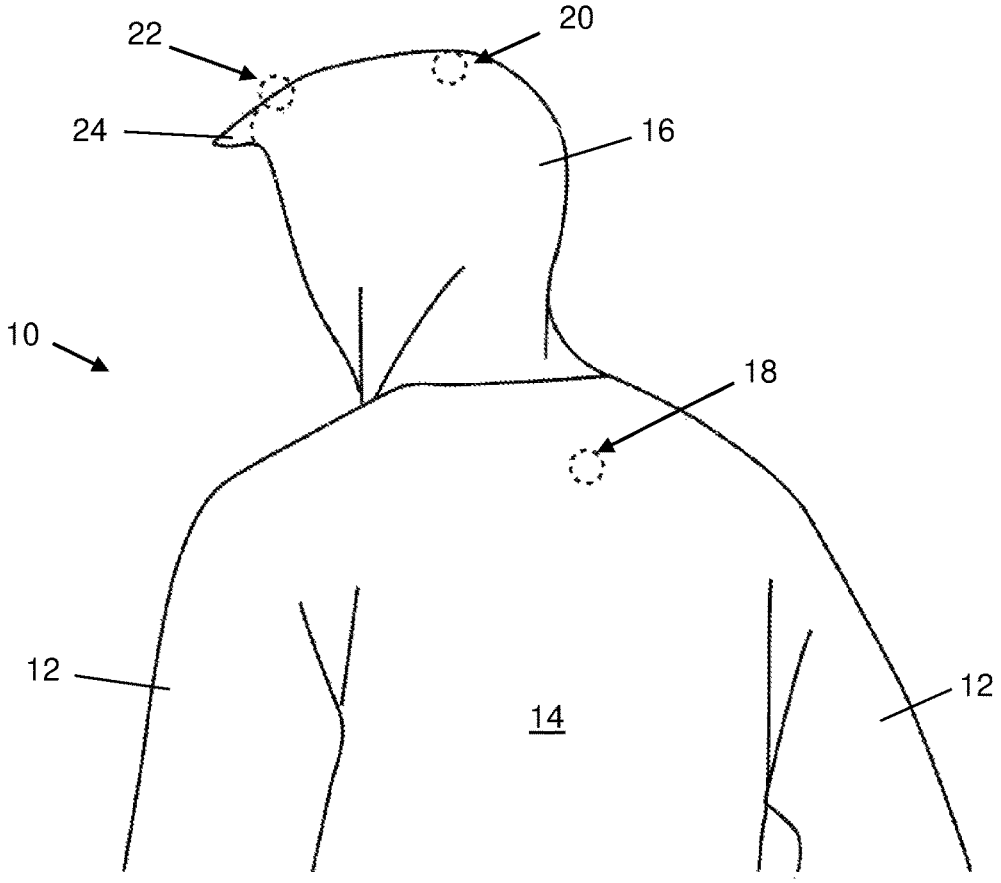
FIG. 1 shows an oblique posterior view of an upper-body garment according to the present invention, with a hood in its deployed position.

Referring to the drawings, an example of an upper-body garment according to the present invention, in the form of a jacket, is identified generally by reference number 10.

The jacket 10 comprises of a main garment portion that extends around the wearer's torso and that has sleeves 12 to extend around the wearer's arms. The main garment portion is identified herein below as the main portion 14. In other embodiments of the invention, the main portion need not have sleeves (e.g. it can be a hooded waistcoat or poncho) and the main portion need not extend completely around the wearer's torso.

The jacket includes a hood 16 that is attached to the main portion 14 in a neck region of the jacket 10. The hood 16 is preferably integrally formed or permanently attached to the main portion, e.g. it can be stitched to the main portion or can simply extend contiguously with the main portion. In other embodiments of the invention, the hood 16 can be releasable from the main portion 14, but such a releasable attachment is generally superfluous, for reasons provided below.

Figure 3:
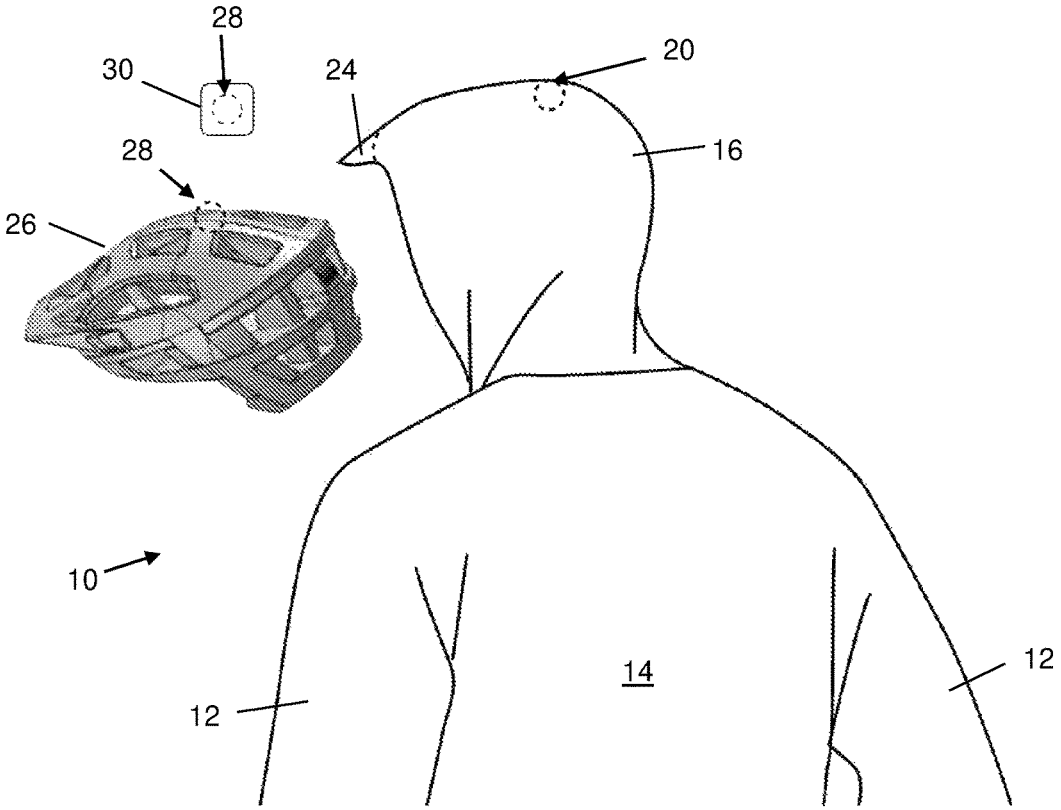
FIG. 3 shows an oblique posterior view of a kit comprising the garment of FIG. 1, and a retention accessory, as well as helmet on which the retention accessory has been fitted.
Figure 4:
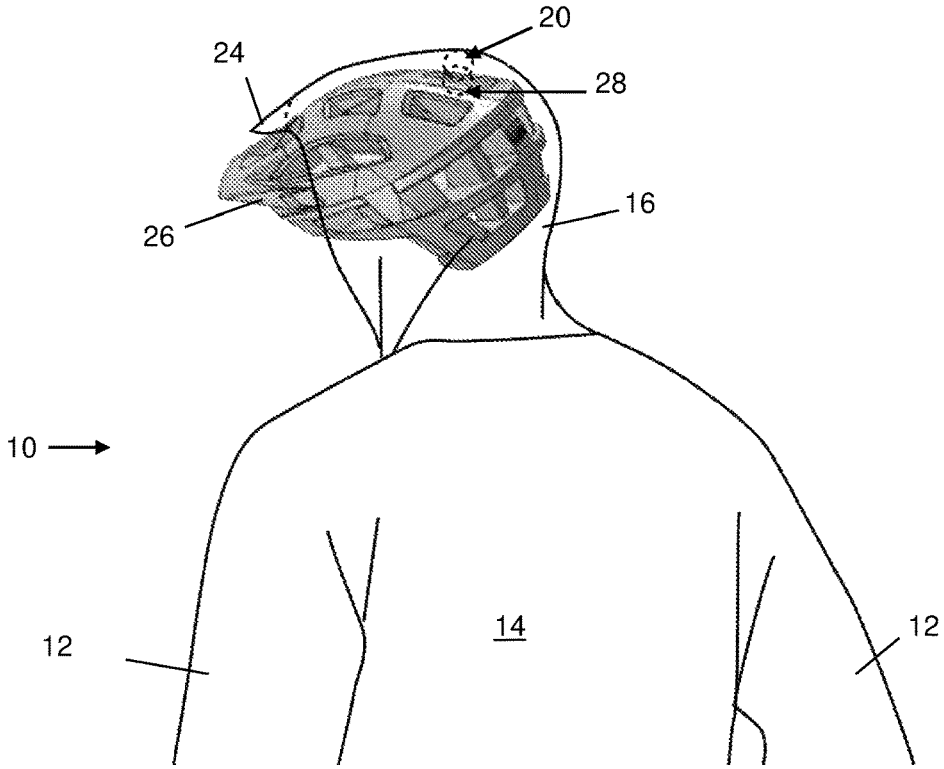
FIG. 4 shows an oblique posterior view of the garment of FIG. 1, with its hood in its deployed position, over a helmet.

The hood 16 can be donned by the wearer in a deployed position i.e. "up", as shown in FIGS. 1, 3 and 4, where the hood extends partly around the wearer's head. Preferably, the hood extends contiguously with the main portion 14 around the wearer's head and neck on all sides, except for an opening at the front, which leaves the wearer's face open. However, the extent to which the hood 16 covers the wearer's head can vary between different embodiments of the invention.

Figure 2:
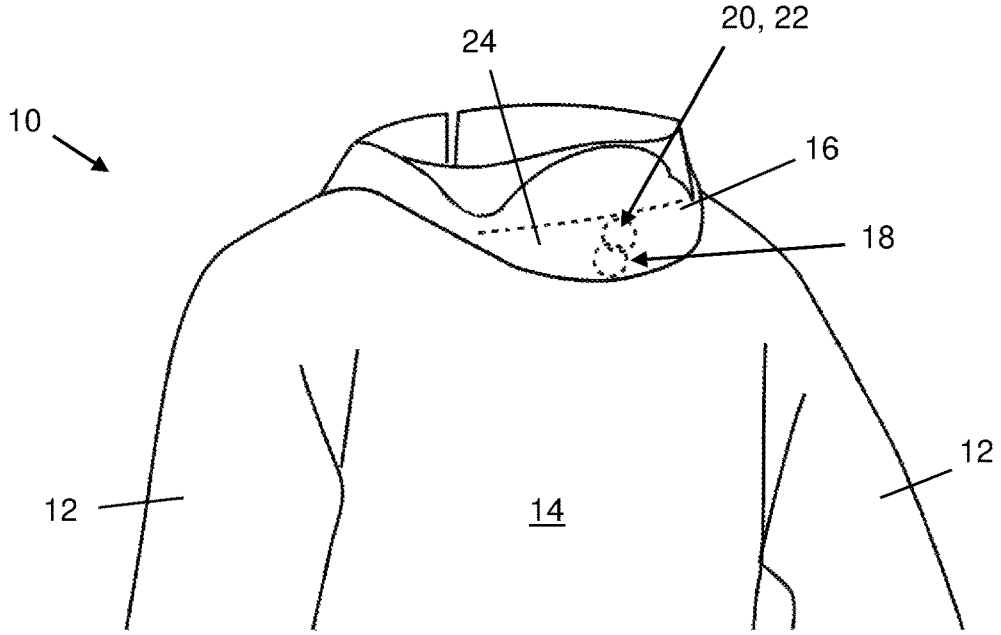
FIG. 2 shows an oblique posterior view of the garment of FIG. 1, with its hood in its retained position.

The hood 16 can also be removed from the wearer's head and can be left to be draped behind the wearer's back, i.e. the hood can be "down" in the conventional manner, but the present invention allows the hood to be stowed or retained, instead, in a retained position behind the wearer's neck or back, as shown in FIG. 2, in which at least part of the hood is retained in close proximity to the main portion 14 by retention elements.

One or more first retention elements are provided on the main portion 14 and at least one such first retention element 18 is preferably attached to the main portion in a position corresponding to the region of the nape of the wearer's neck. One or more second retention elements are attached to the hood 16, such as a centre retention element 20 that is disposed in a crown region of the hood and a front retention element 22 that is disposed further forward on the hood. In the illustrated embodiment, the front retention element 22 is adjacent a stiff peak element 24, but the peak element can be absent in other embodiments.

The exact number an positions of the first and second retention elements 18,20,22 can vary, as long as at least one first retention element 18 is attached to the main portion 14, preferably behind the wearer's neck or upper back, and as long as at least one second retention element 20,22 is attached to the hood 16, preferably in a position that corresponds to an upper head of the wearer—higher than the occipital region.

The first and second retention elements 18,20,22 are magnetically attracted to each other. Preferably, the first and second retention elements 18,20,22 are all magnets, e.g. they can be small, strong magnets such as rare earth magnets. However, in some embodiments some of the retention elements may be of ferrous metal or the like, so that they are attracted to the retention elements that are magnets. It is essential that at least one of the second retention elements 20,22 is magnetically attracted to the first retention element 18. In some embodiments, it may be preferred that the second retention elements 20,22 are also attracted to each other, are neutral towards each other, or repel each other.

The first and second retention elements 18,20,22 are preferably embedded in fabric of which the hood 16 and main portion 14 are made, so that the retention elements provide no visual detraction and so that they are protected from snagging. The retention elements 18,20,22 can be sewn into the jacket 10, can be adhesively attached to the fabric, can be received in suitable pockets, or the like.

Referring to FIG. 3, if the jacket 10 is intended for use with a helmet 26, with the hood 16 optionally, selectively worn over the helmet, a third retention element 28 can be attached to the helmet. The third retention element 28 can be embedded in the helmet 26, but in order to allow the jacket 10 to be used with various helmets, the third retention element can form part of a retention accessory 30 that can be adhesively attached to the outside of the helmet.

The position of the third retention element 28 on the helmet 26 would depend on the position of the second retention elements 20,22 in the hood 16 and how the wearer would prefer that the hood is attached to the helmet, but preferably, the third retention element would be attached to the helmet generally in a crown region of the helmet i.e. on top of the helmet. The third retention element 28 is magnetically attracted to at least one of the second retention elements 20,22 and it is irrelevant whether or not there is any magnetic interaction between the first retention element 18 and the third retention element 28.

The third retention element 28 is preferably supplied as part of the retention accessory 30 in the form of a peel-off sticker, in a kit that includes the jacket 10, to allow the third retention element to be attached to any helmet, so that the helmet with the third retention element can be used with the jacket, in a set.

In use, the jacket 10 can be worn like any other jacket, with its hood 16 up or down, as the wearer wishes. If the jacket 10 is used without the helmet 26 (i.e. without the third retention element 28), then when the hood 16 is up, it will simply extend over the wearer's head as shown in FIG. 1, providing warmth and/or protection to the wearer's head. If desired, the wearer can wear a helmet over the hood 16. While the jacket 10 is worn with the hood 16 up, the first retention element 18 is too far from the second retention elements 20,22 for significant magnetic attraction between the first and second retention elements.

The hood 16 can also be removed from the wearer's head or taken down, in a simple convention motion (which only requires a simple hand movement), but unlike a conventional hood that would remain loosely draped behind the wearer's back, potentially causing nuisance for the wearer, one or preferably both the second retention elements 20,22 will be magnetically attracted to the first retention element 18 and will self-locate to the retained position shown in FIG. 2, in which the hood is snugly retained behind the wearer's neck, with the second retention elements 20,22 in close proximity to the first retention element and strongly magnetically attracted to the first retention element. In the illustrated embodiment, the peak element 24 forms a stiff cover for the hood 16 while in its retained position.

While the hood 16 is in its retained position, the magnetic attraction between the first and second retention elements 18,20,22 is strong enough to retain it against most wind force and to prevent the hood from being a nuisance to the wearer.

When the wearer wants the hood 16 up again, he simply tugs on the hood or performs any other action that separates the first and second retention elements 18,20,22, e.g. he pulls upwards on the peak element 24, to release the magnetic attraction between the first and second retention elements sufficiently and he deploys the hood by pulling it up over his head. Once the hood 16 is pulled up, the second retention elements 20,22 are too far from the first retention elements to be attracted to it, so the hood generally remains in its up position.

If the jacket 10 is used with the helmet 26, instead of deploying the hood 16 to extend over the head of the wearer as shown in FIG. 1, the wearer can pull the hood over the helmet and the central second retention element 20 can attach magnetically to the third retention element 28 on the helmet, when it comes in close proximity to the third retention element. While the hood 16 is deployed over the helmet 26 in this manner, the magnetic attachment between the second and third retention elements 20,28 holds the hood in place, despite moderate head movements of the wearer, moderate winds, or the like.

When the wearer wants to remove the hood 16 from the helmet, the magnetic attachment between the second and third retention elements 20,28 is interrupted manually by pulling the hood down.

The invention claimed is:

1. An upper-body garment comprising:

a main garment portion that is configured for extending at least partly around a torso of a wearer;

a hood that is attachable to the main garment portion in a neck region of the garment, said hood being displaceable at least between: a deployed position in which the hood extends partly around a head of, the wearer and a retained position in which the hood is disposed at least partly behind the wearer with the wearer's head being outside the hood;

said garment including at least a first retention element that is attached to the main garment portion and a second retention element that is attached to the hood;

wherein said second retention element is attached to the hood at a position that is remote from the first retention element when the hood is in the deployed position, and that is in close proximity to the first retention element when the hood is in the retained position;

characterised in that said first retention element and second retention element are magnetically attracted to each other, when they are in close proximity to each other.

2. The upper-body garment according to claim 1, in which the second retention element is attached to the hood at a position that is higher than an occipital region of the wearer's head, when the hood is in the deployed position.

3. The upper-body garment according to claim 1, in which the first retention element is attached to the main garment portion at a position that is in the region of a nape of the wearer's neck.

4. The upper-body garment according to claim 1, wherein at least one of the first and second retention elements is embedded in fabric of the upper body garment.

5. The upper body garment according to claim 1, in combination with a helmet, said helmet including at least a third retention element and said second and third retention elements being magnetically attracted to each other, when they are in close proximity.

6. The upper body garment and helmet according to claim 5, wherein the third retention element is disposed in the helmet at a position that is higher than the occipital region of the wearer's head, when the helmet is worn by the wearer.

7. A method of selectively retaining a hood, said method comprising:

providing a garment comprising main garment portion that is configured for extending at least partly around a torso of a wearer, a hood that is attachable to the main garment portion in a neck region of the garment, and at least a first retention element that is attached to the main garment portion and a second retention element that is attached to the hood, said first retention element and second retention element being magnetically attracted to each other, when they are in close proximity;

selectively retaining the hood in a retained position in which the hood is disposed at least partly behind the wearer with the wearer's head being outside the hood, by bringing the second retention element into such close proximity of the first retention element, to allow the first retention element and the second retention element to be magnetically attracted to each other; and selectively deploying the hood to a deployed position in which the hood extends partly around the wearer's head, by moving the second retention element from the proximity of the first retention element, to avoid magnetic attraction between the first retention element and the second retention element.

8. The method according to claim 7, in which the wearer wears a helmet on his head, said helmet including a third retention element, and said method including releasably attaching the second retention element magnetically to the third retention element, when the hood is in its deployed position.

* * * * *